US006869159B2

(12) United States Patent
Hasseler et al.

(10) Patent No.: US 6,869,159 B2
(45) Date of Patent: Mar. 22, 2005

(54) CONTAMINATION MANAGEMENT SYSTEM AND METHOD

(75) Inventors: Kelvin J. Hasseler, Murrieta, CA (US); Michael Klausbruckner, San Diego, CA (US); Farmid Mahtafar, Poway, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 70 days.

(21) Appl. No.: 10/407,120

(22) Filed: Apr. 4, 2003

(65) Prior Publication Data

US 2004/0196323 A1 Oct. 7, 2004

(51) Int. Cl.[7] ..... B41J 29/393; B41J 39/38
(52) U.S. Cl. ..... 347/19; 347/13; 347/14
(58) Field of Search ..... 347/12, 13, 14, 347/19, 29, 40, 42, 49

(56) References Cited

U.S. PATENT DOCUMENTS 5,461,405 A 10/1995 Lehmann et al.
6,089,693 A 7/2000 Drake et al.
6,739,701 B2 * 5/2004 Silverbrook ..... 347/49
2002/0191046 A1 * 12/2002 Otsuki ..... 347/43

FOREIGN PATENT DOCUMENTS

DE 4344746 6/1995
JP 57020361 2/1982

OTHER PUBLICATIONS

Hewlett–Packard Company, "Thermal Inkjet (TIJ) Technologies: c8863a OEM Setup Printhead", 2001, 1 page.

Hewlett–Pakcard Company, "HP Industrial Inkjet Print Engine Architecture Proposal; specialty printing system," Apr. 4, 2003, pp. 1–15.

Hewlett–Packard Company, "HP C7802A Printhead Stall; Technical Data Sheet", Dec. 6, 2000, pp. 1–40.

* cited by examiner

*Primary Examiner*—Stephen D. Meier
*Assistant Examiner*—Alfred Dudding

(57) ABSTRACT

An implementation of a technology is described herein for maintaining the operability of fluid-ejection mechanisms and their associated sockets.

19 Claims, 10 Drawing Sheets

160
170
Containmnation Management System
150
120
332d
332a
332b
332c
100
110

CONTAMINATION MANAGEMENT SYSTEM AND METHOD

BACKGROUND

Ink-jet printing mechanisms are used in a variety of different "marking devices," such as plotters, facsimile machines and ink jet printers, to print images using a colorant, referred to generally herein as "ink." These ink-jet printing mechanisms use ink-jet cartridges or fluid-ejection mechanisms, often called "print cartridges," to shoot drops of ink onto a page or sheet or web or product of print media.

Each fluid-ejection mechanism has a printhead formed with very small nozzles through which the ink drops are fired. The particular ink ejection mechanism within the printhead may take on a variety of different forms known to those skilled in the art, such as those using piezo-electric or thermal printhead technology.

Because of many factors (such as the use of small nozzles and quick-drying ink), these fluid-ejection mechanisms are susceptible to failure in the event that some or all of the nozzles become clogged due to lack of use or with contaminates such as dried ink or minute dust particles. Therefore, these ink-jet fluid-ejection mechanisms are typically designed to be replaceable. Therefore, if a fluid-ejection mechanism fails, it is typically removed and replaced with an operational one.

Typical Translational Printhead Assembly

In a typical small- to medium-scale ink-jet printer, the printer prints an image by scanning the printhead back and forth across a printzone above the sheet, with the fluid-ejection mechanism shooting drops of ink as it moves. The ink is expelled in a pattern on the print media to form a desired image (e.g., picture, chart or text).

These typical small- to medium-scale ink-jet printers employ one or more "translational" printhead assemblies since the printhead moves in the printzone above the sheet during printing.

To clean and protect the translational printhead, these printers typically employ a "service station" mechanism. The service station mechanism is typically mounted within the device chassis so the printhead can be moved over the station for maintenance. For storage, or during non-printing periods, the service stations usually include a capping system which hermetically seals the printhead nozzles from contaminants and drying. Many service station mechanisms also include a mechanism for wiping the printhead surface to remove ink residue, as well as any paper dust or other debris that has collected on the face of the printhead.

SUMMARY

Described herein is a technology for maintaining the operability of fluid-ejection mechanisms and their associated sockets.

In one embodiment, the invention may comprise a method for reducing contamination of fluid-ejection mechanisms and associated sockets, the method comprising: analyzing a print job to identify a fluid-ejection mechanism that is unnecessary for printing the print job; receiving communication from a socket sealer disposed in a socket vacated by the identified unnecessary fluid-ejection mechanism; indicating whether the socket vacated by the unnecessary fluid-ejection mechanism is sealed, based upon the communication from the socket sealer.

BRIEF DESCRIPTION OF THE DRAWINGS

The same numbers are used throughout the drawings to reference like elements and features.

DETAILED DESCRIPTION

The following description sets forth one or more exemplary implementations of a contamination management system and method. The inventors intend these exemplary implementations to be examples. The inventors do not intend these exemplary implementations to limit the scope of the claimed present invention. Rather, the inventors have contemplated that the claimed present invention might also be embodied and implemented in other ways, in conjunction with other present or future technologies.

An example of an embodiment of a contamination management system and method may be referred to as an "exemplary contamination management system."

Stationary Printhead Assembly

Large-scale ink-jet printers are designed to produce a massive volume of printed output. A common variety of such a printer is called a "page-wide" or inline printer because it is capable of printing an entire page-width at a time. Often, these printers are used as variable data printers.

Figure 1A:
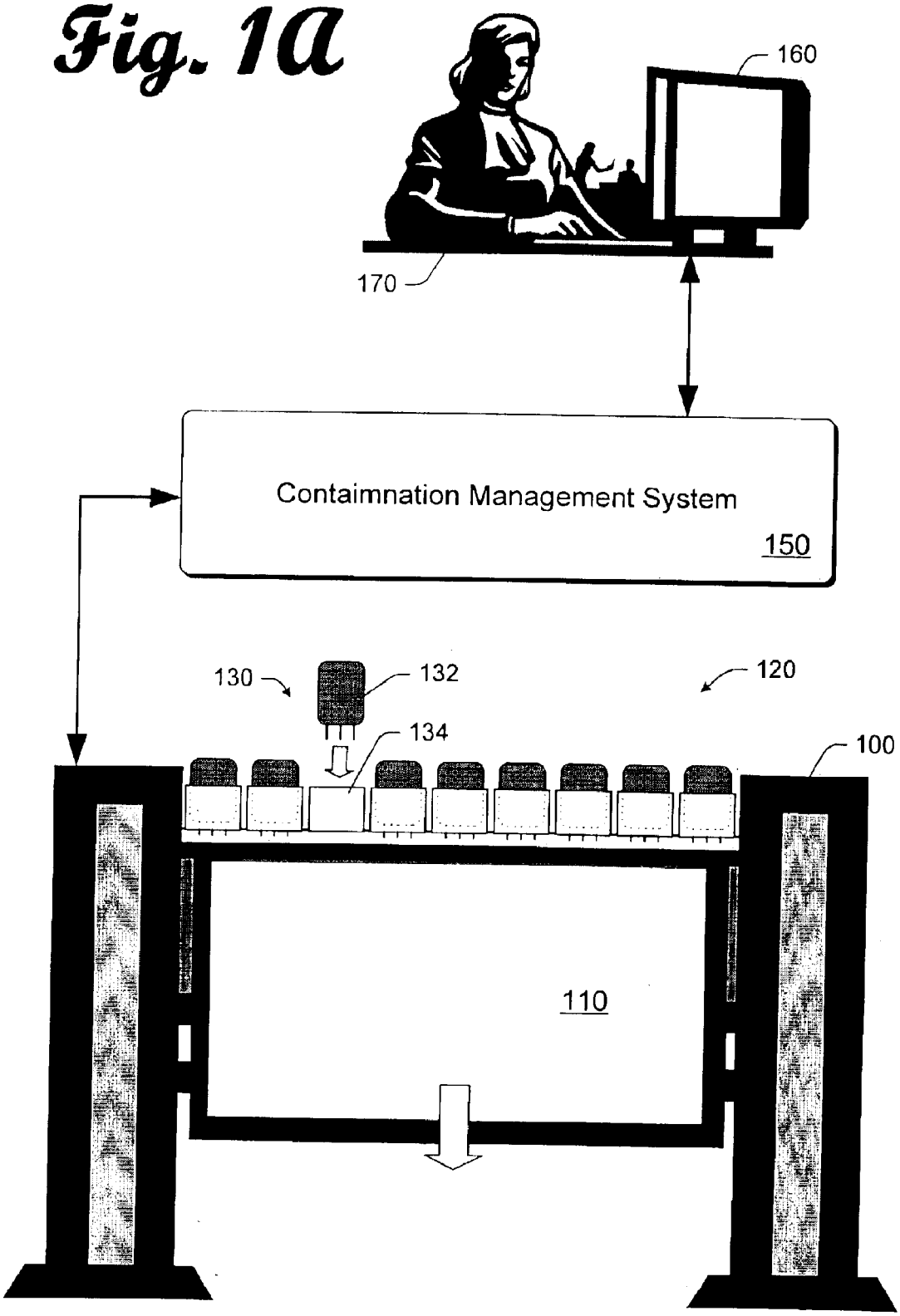
FIG. 1A illustrates an environment in accordance with an implementation described herein and it also illustrates the removability of fluid-ejection mechanisms.

FIG. 1A shows an example of a page-wide large-scale ink-jet printer 100. Some of these printers, like printer 100, employ an array 120 (i.e., one or more rows) of stationary ink-jet printhead assemblies. So, unlike the translational printhead assemblies of the small- to medium-scale printers, the printhead assemblies of these large-scale printers are fixed, while the print media (such as print media 110) moves underneath.

As shown in FIG. 1A, a typical printhead assembly 130 includes a fluid-ejection mechanism 132 (or a collection of fluid-ejection mechanisms) and a stationary electromechanical socket 134 (which may also be called a "pocket"). These sockets are designed to receive the ink-jet fluid-ejection mechanisms (as shown in FIG. 1A). Therefore, the fluid-ejection mechanisms are stationary because their sockets are stationary during printing.

Figure 7:
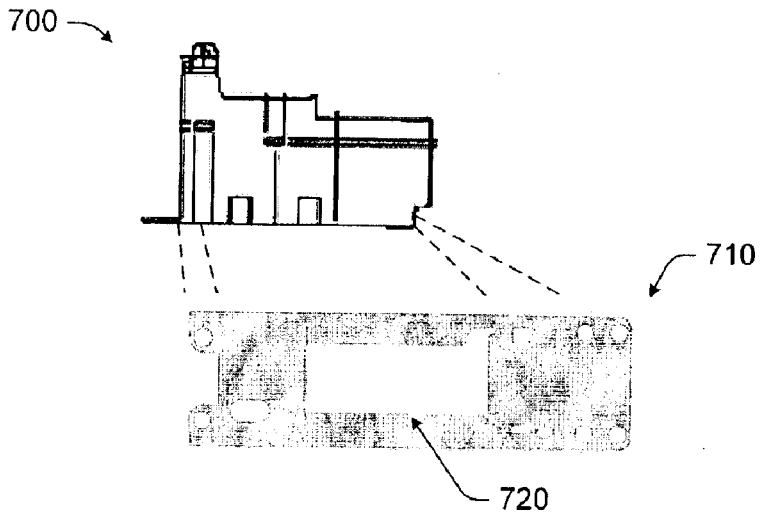
FIG. 7 shows an example of a socket and its seal that may be used in accordance with an implementation described herein.

FIG. 7 shows an example of a socket at 700. Furthermore, an example of a typical stall is described in "HP C7802A Printhead Stall Technical Data Sheet" from the Hewlett-Packard Company (Revision E Dec. 6, 2000). That document is incorporated herein by reference.

Sandwiched between the socket and the mounting plate (not shown) for the socket on a printer is a seal 710. In one implementation, it is a flexible Mylar seal that is typically approximately 0.1 mm thick.

The seal 710 is a sheet of flexible Mylar is sandwiched between the socket and the mounting plate located in the socket. The seal 710 has a "cut-out" (i.e., a hole) 720, through which the fluid-ejection mechanism is pushed during socket insertion. The hole 720 is slightly smaller than the fluid-ejection mechanism. During insertion of the fluid-ejection mechanism, this sheet deflects—resulting in a tight seal around the printhead.

As the printer 100 prints, paper 110 (or other media) passes by the array 120 of fluid-ejection mechanisms. This creates dust and/or churns-up dust from the paper. Also, the ink-jet printing process of a fluid-ejection mechanism typically produces a small cloud of ink aerosol. Furthermore, there simply is dust in the environment. These contaminates may clog the fluid-ejection mechanism nozzles and interfere with the operation of a fluid-ejection mechanism.

Typically, fluid (e.g., ink) is continuously ejected from the nozzles to prevent the fluid from drying in the nozzles of the fluid-ejection mechanism and to continuously clear the nozzles from any kind of contamination or dust. If a fluid-ejection mechanism remains dormant during a printing cycle, fluid may dry in the nozzles and contaminates may clog the nozzles.

To address the contamination issue, the fluid-ejection mechanisms in this type of large-scale printer are often designed to have regular manual maintenance performed on them. Such maintenance includes being serviced, capped, wiped, cleaned, and the like. However, as a practical matter, the fluid-ejection mechanisms of such printers are frequently not maintained in such a manner or the intervals between such maintenance are longer than recommended.

Consequently, contamination causes these neglected fluid-ejection mechanisms to fail and requires that these fluid-ejection mechanisms be replaced before they reach the natural conclusion of their life-cycle. Such contamination could have otherwise been eliminated or reduced by regular maintenance as per its original design.

Exemplary Contamination Management

The one or more exemplary implementations, described herein, of the present claimed invention may be implemented (in whole or in part) by a contamination management system 150 and/or by a computing environment.

The exemplary contamination management system helps maintain the operability of the printhead assemblies (comprising the fluid-ejection mechanisms and their sockets) that are used for ink-jet printing of large-scale printers.

As part of that, the exemplary contamination management system helps protect the sockets (e.g., socket 134 of FIG. 1A) into which replaceable fluid-ejection mechanisms (e.g., fluid-ejection mechanism 132 of FIG. 1A) are inserted. These sockets have sensitive electronics inside and, like the fluid-ejection mechanisms, are vulnerable to damage by excessive contamination.

Furthermore, the exemplary contamination management system helps extend the life of fluid-ejection mechanisms by identifying those that will be unused (for a specified time period and/or for one or more print jobs) so that the identified fluid-ejection mechanisms may be removed from the printer. If these "unnecessary" fluid-ejection mechanisms remained in the printer, they would be subject to otherwise unnecessary contamination.

Figure 1B:
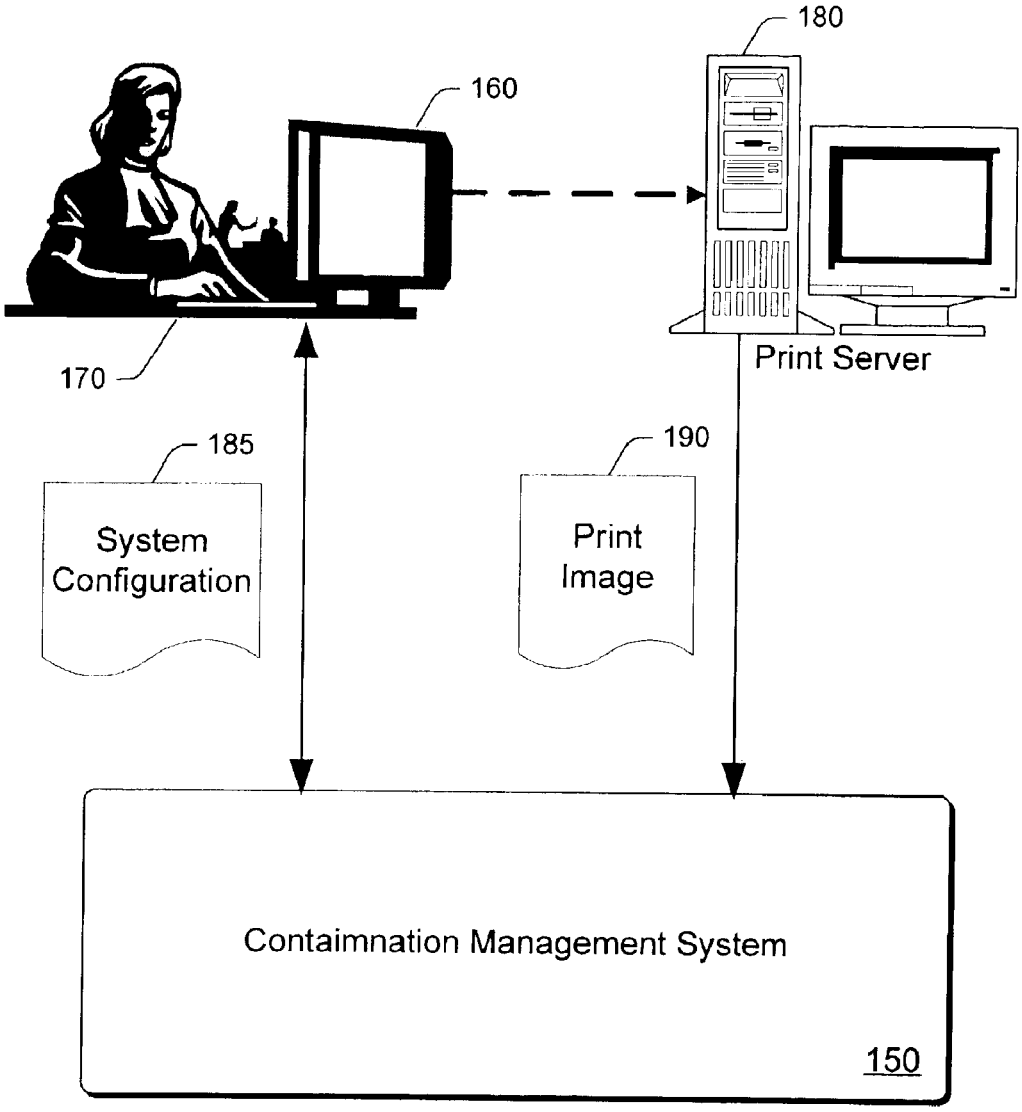
FIG. 1B illustrates an environment in accordance with an implementation described herein.

The printer 100 and its associated components (shown in FIG. 1A) are described above. FIG. 1A also shows the contamination management system 150, a user interface (UI) device 160, and an operator 170. In addition, FIG. 1B shows example interaction between a print server 180, system configuration settings 185, and a print image 190.

The contamination management system 150 is communicatively coupled to the printer 100 and the UI device 160. Of course, the contamination management system 150, the printer 100, and the UI device 160 may be separate components or they be may integrated into common housing.

Figure 5A:
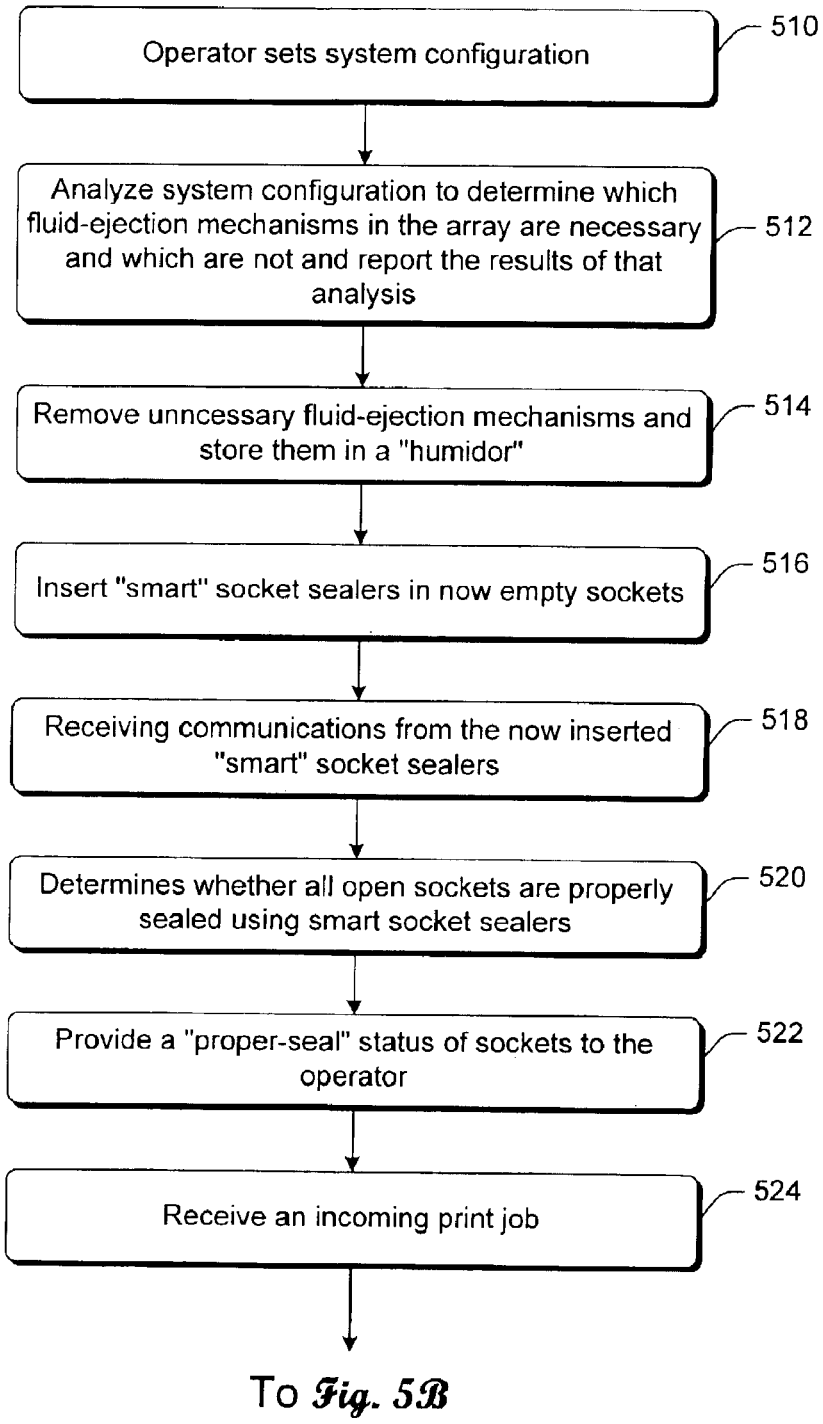
FIGS. 5A and 5B are a flow diagram showing a methodological implementation, in accordance with an example embodiment.
Figure 5B:
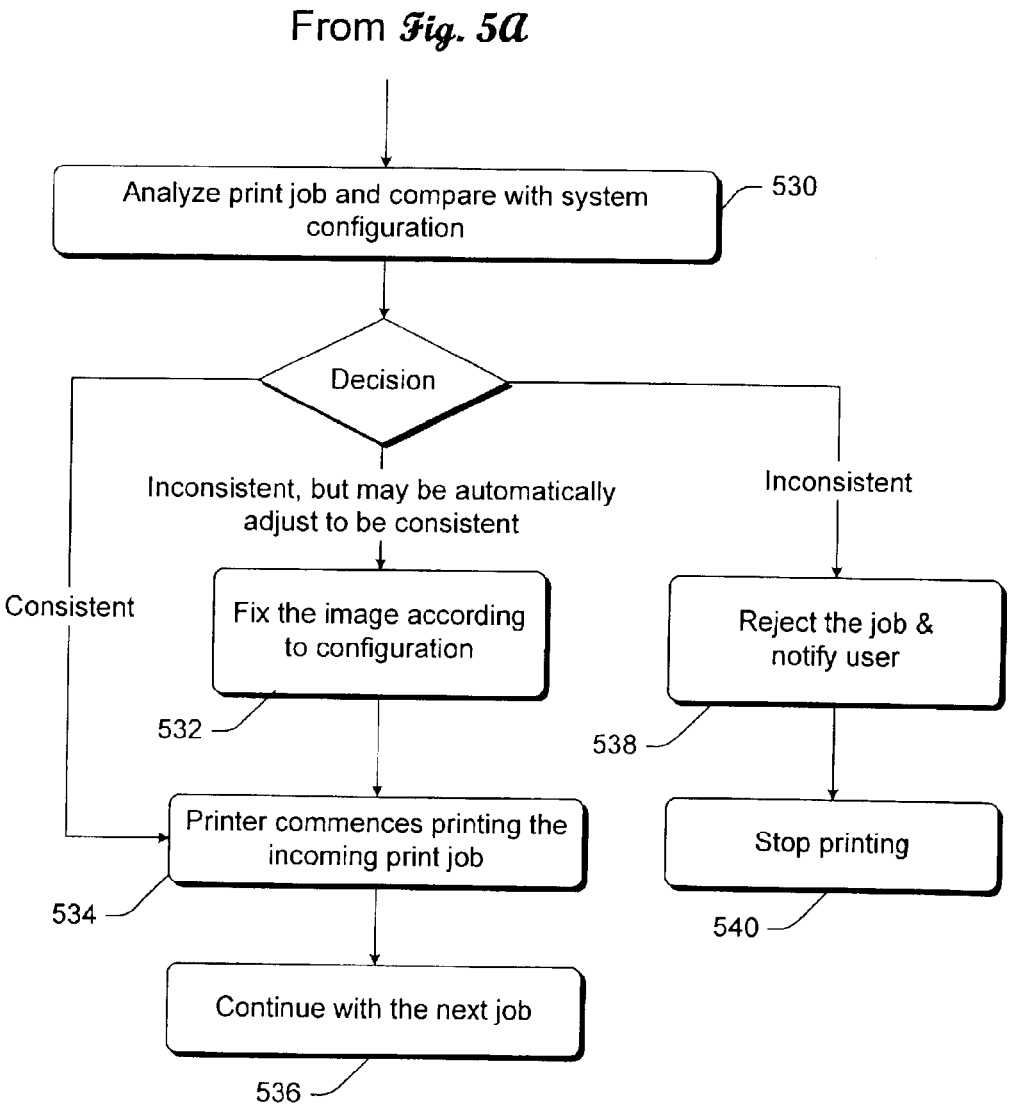

FIGS. 1A, 1B, 2, 3, and 4, illustrate example operation of the contamination management system 150. Furthermore, FIGS. 5A and 5B show an example methodological implementation of the contamination management system 150 (or some portion thereof). This methodological implementation may be performed in software, hardware, or a combination thereof.

At 510 of FIG. 5A, the operator 170 sets the system configuration. Through a control panel graphical user interface (GUI) or via the UI device 160, the operator 170 sets the configuration settings 185 for the printer 100. Examples of such setting include the arrangement of the fluid-ejection mechanisms in the printer, print speed, print mode, and the like. These settings are typically stored at the UI device 160, the contamination management system 150, the print server 180, or at the printer 100, itself. Alternatively, these settings may be stored with the print image 185 (or at least in association with a particular print job) on the print server 180.

The operator may set the configuration in response to an analysis of an incoming print job. Such an analysis is performed by the contamination management system 150 and is described in the blocks illustrated in FIG. 5B (in particular, blocks 530 and 538). This analysis may determine which fluid-ejections mechanisms are necessary and which are not necessary for a particular incoming print job.

The contamination management system 150 determines whether the system configuration 185 is consistent (e.g., fully aligned) with the print image 190 and if inconsistent, if it is able to modify the print image slightly to achieve consistency.

When the contamination management system receives a print image 190 to print, the size of the image is typically indicated in the image header. The system checks that the image width is consistent with the configured number of actually installed fluid-ejection mechansims. If the image width is different than the configuration, the system may either reject the incoming print job, or if the image is slightly smaller, it may add zero data (adding blanks to the right or the left edge of the image). If the image width is slightly larger than configuration, the system may clip the edges or scale down the image.

If the configuration is inconsistent with the print image and the system 150 is unable to modify the print image to achieve consistency, then the system 150 communicates this inconsistency condition to the operator 170 via the UI device 160. When the system configuration 185 and print image 190 do not match (an inconsistency condition described below with blocks 530 and 538), then the operator may change the configuration accordingly.

At 512, based upon the current system configuration, the contamination management system 150 indicates, or identifies, to the operator 170 via the UI device 160 which fluid-ejections mechanisms in the array are employed in this configuration and which are not. In light of the system configuration, some fluid-ejection mechanisms are necessary and some are not for a given print job. This UI device 160 may display a graphical user interface (GUI) that graphically illustrates the current status information, which includes, for example, identification of which sockets are open or sealed, and if sealed whether a socket holds a socket sealer or a fluid-ejection mechanism.

If a fluid-ejection mechanism is deemed unnecessary based upon the analysis of the system configuration 185, then it is desirable to remove that fluid-ejection mechanism from the array 120 so that it will not be unnecessarily subjected to high contamination conditions. Since the unnecessary fluid-ejection mechanism is not needed, it is better to remove it from the array. In some instances, multiple fluid-ejection mechanisms may be deemed unnecessary for a given print job.

Figure 2:
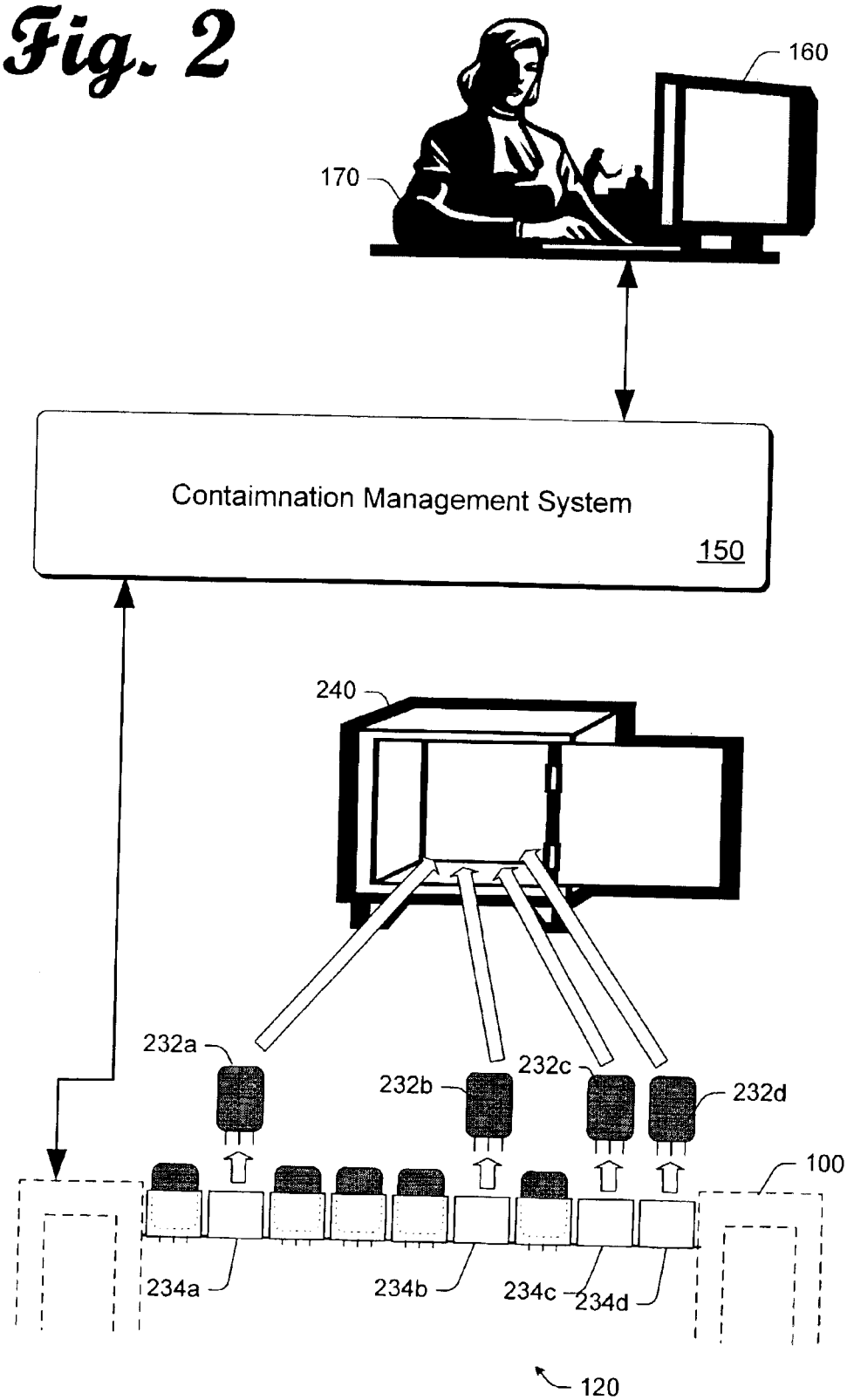
FIG. 2 illustrates the same environment as FIG. 1A and further illustrates a part of the operation (e.g., removal and storage of fluid-ejection mechanisms) of an implementation described herein within that environment.

Using the UI device, the operator may identify the unnecessary fluid-ejection mechanisms. As shown in FIG. 2, fluid-ejection mechanisms 232*a,* 232*b,* 232*c,* and 232*d* are designated for removal. Accordingly, the operator 170 removes these identified unnecessary fluid-ejection mechanisms and places them in a fluid-ejection mechanism-servicing storage unit 240. This storage unit is also called a "humidor." It is designed to receive such fluid-ejection mechanisms. The servicing storage unit 240 services the fluid-ejection mechanisms in a controlled climate (which is often humid).

The servicing storage unit 240 cleans, maintains, protects and/or recovers the correct operation fluid-ejection mechanisms stored therein.

The unit 240 may include a capping system which hermetically seals the printhead nozzles from further contaminants and prevents drying. Some caps are also designed to facilitate priming, such as by being connected to a pumping unit or other mechanism that draws a vacuum on the fluid-ejection mechanisms.

The unit 240 may also have an elastomeric wiper that wipes the surface of the fluid-ejection mechanism to remove ink residue, as well as any paper dust or other debris that has collected on the face of the printhead.

Block 514 of FIG. 5A shows the removal of unused fluid-ejection mechanisms and their placement into fluid-ejection mechanism-servicing storage unit (i.e., humidor).

When the operator removes the unnecessary fluid-ejection mechanisms, she leaves the associated sockets 234*a,* 234*b,* 234*c,* and 234*d* of fluid-ejection mechanism empty. If left that way, the interconnectivity electronics associated with the empty sockets would be subjected to contamination by dust and accumulated ink aerosol.

Figure 3:
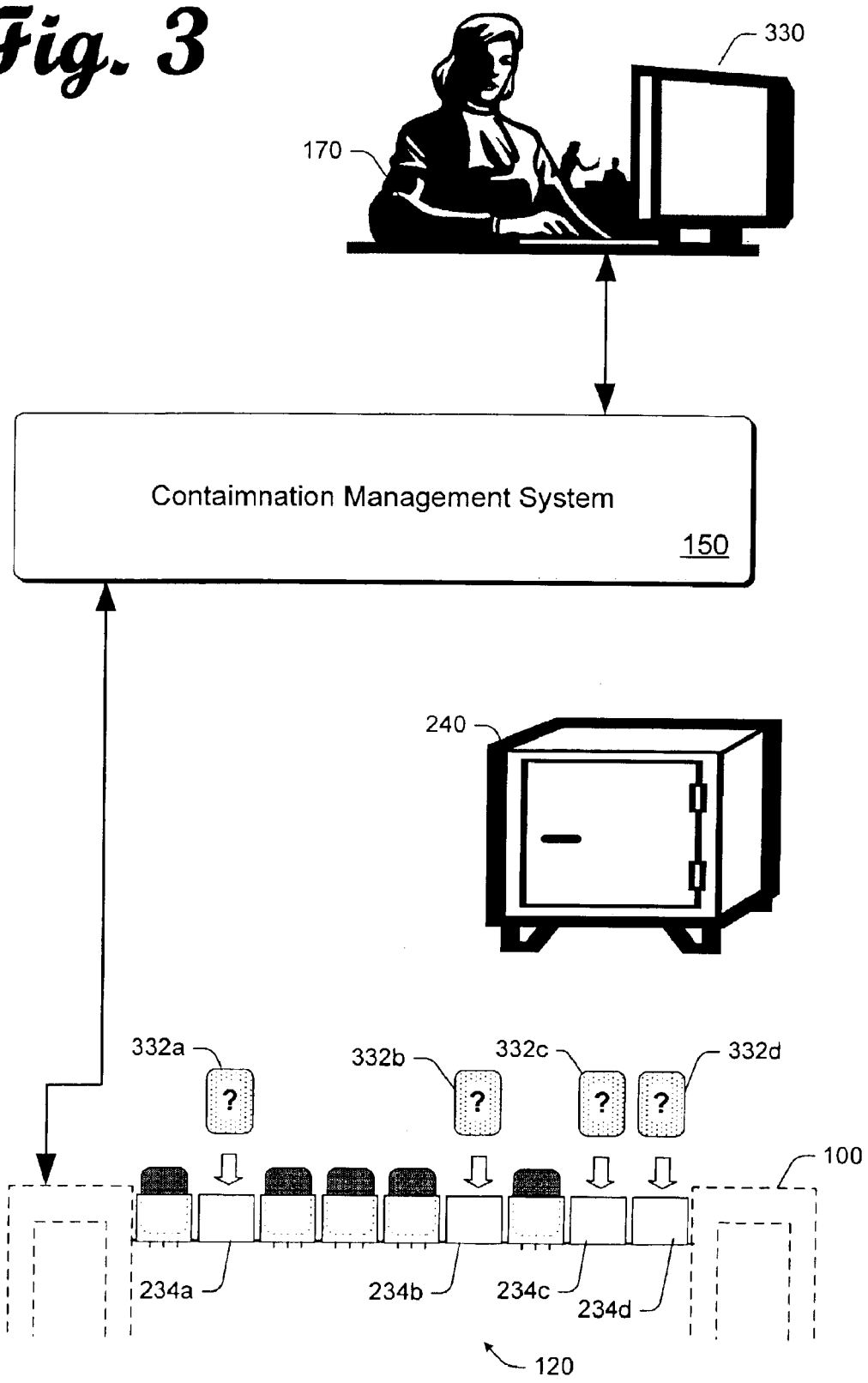
FIG. 3 illustrates the same environment as FIG. 1A and further illustrates a part of the operation (e.g., insertion of sealing devices) of an implementation described herein within that environment.
Figure 4:
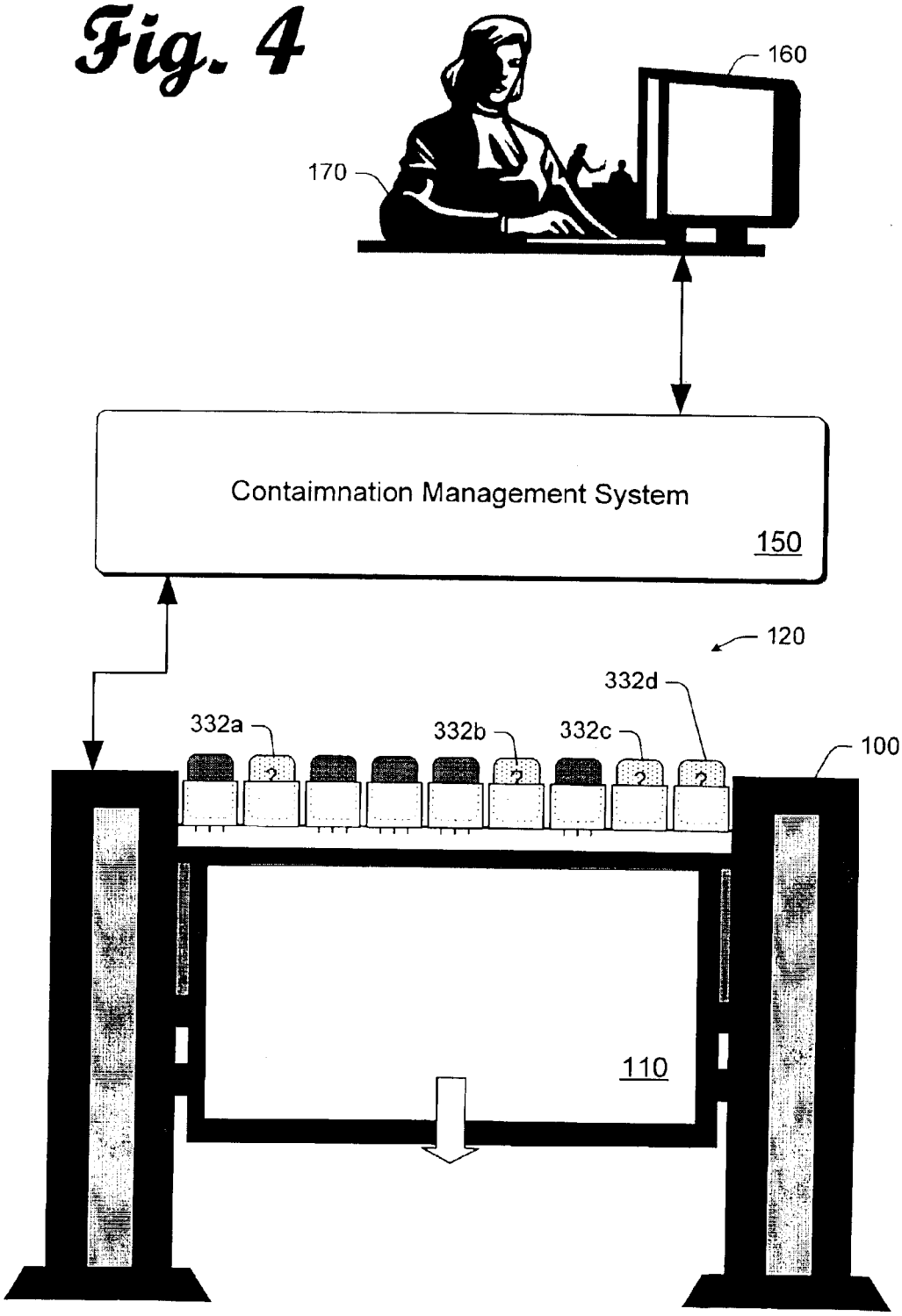
FIG. 4 illustrates the same environment as FIG. 1A and further illustrates a part of the operation (e.g., with sealing devices in place) of an implementation described herein within that environment.

As shown in FIG. 3, the operator 170 replaces the removed fluid-ejection mechanisms with a socket sealing mechanism, such as socket sealers 332*a,* 332*b,* 332*c,* and 332*d,* thereby filling the otherwise empty sockets.

These socket sealers typically look similar to fully-functional fluid-ejection mechanisms, but, in some embodiments, they not configured to eject fluid and do not include nozzles for ejecting fluid, such as ink, onto a print media. Hence, these socket sealers may be referred to as non-printing cartridges.

Block 516 of FIG. 5A shows the insertion of the socket sealers.

One of the main purposes of a socket sealer is to fill the otherwise empty socket, thus sealing the socket's orifices and protecting the socket from contaminates. It is desirable to employ a seal between the socket and the socket sealer to keep out all or nearly all dust and aerosols.

Some embodiments of these socket sealers include a limited degree of electronics for interfacing with the printer. They may have a configurable non-volatile memory (a so-called "smart chip") embedded into the socket sealer to provide positive identification to the printer. These "smart" socket sealers may be programmable.

Conventionally, such "smart" socket sealers are typically used for calibration. An example of one is described in the "c8863a OEM Setup Printhead Product Data Sheet" (Revision A; 24 May 2001) from the Hewlett-Packard Company. That document is incorporated herein by reference.

Figure 6:
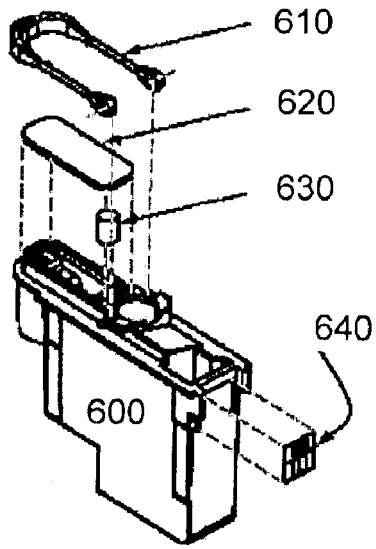
FIG. 6 illustrates an example of a socket sealer that may be used in accordance with an implementation described herein.

FIG. 6 illustrates an example of a "smart" socket sealer at 600. It has a handle 610 and a cover 620. Inside a plug 630. The sealer has a non-volatile memory 640, that is typically called a "smart chip."

At 518 of FIG. 5A, the smart socket sealers interface with the printer using its smart chip 640. This interface will indicate the status of the socket sealer, such as whether it is properly inserted and sealed.

At 520, the contamination management system 150 determines whether all sockets (such as sockets 234*a,* 234*b,* 234*c,* and 234*d*) are properly sealed using smart socket sealers. Thus, the contamination management system 150 monitors communication from the socket sealers in the sockets vacated by the unnecessary fluid-ejection mechanisms.

At 522, using the UI device 160, it provides a "proper-seal" status of sockets to the operator 170. In other words, the UI device confirms the status of the socket sealers, in particular whether the socket sealers are properly installed (thereby, sealing and protecting the sockets). If a socket is not sealed, the operator may reseat the socket sealer and then recheck its status.

At 524 of FIG. 5A, the printer 100 receives an incoming print job. The management system 150 and/or to the printer server 180. The description of this methodological implementation proceeds to FIG. 5B.

At 530 of FIG. 5B, the contamination management system 150 and/or the print server 180 analyzes the yet-to-be-printed print job to determine which fluid-ejection mechanisms in the array 120 are necessary and which are not. It compares that to current system configuration 185. It may utilize image mapping techniques in its analysis.

Thus, the contamination management system 150 acts as an analyzer that analyzes a yet-to-be-printed print job to determine which fluid-ejection mechanisms in the array are unnecessary to print the yet-to-be-printed print job. In one embodiment, a fluid-ejection mechanism is deemed unnecessary to print the print job if the print cartridge is not needed to eject ink onto a print media or the like during the print job.

A software module (not shown) that generates the print image 190 could reside either on the same system that performs containment management or a dedicated computing system (such as print server 180) that is used for that purpose.

Raster Image Processing (RIP) is the name for the process that actually generates the print image according to an example embodiment. The RIP may be performed by a software module (such as a so-called "printer driver") on, for example, the print server 180. This module performs the RIP based, at least in part, on the system configuration 185.

After the analysis of block 530 of FIG. 5B, there are at least three results:

consistent, execution proceeds directly to block 534;

inconsistent, but may be automatically adjusted to be consistent, execution proceeds to block 532;

inconsistent, execution proceeds to block 538.

At 530, the contamination management system 150 analyzes the system configuration 185 to determine if the configuration is consistent (e.g., fully aligned) with the print image 190 and if inconsistent, if it is able to modify the print image slightly to achieve consistency.

The system calculates the print zone of the system based on the configuration. Then the contamination management system 150 gets the print image's dimensions from the data embedded in the image's header. Then the system compares the print zone with the size of the image.

For example for 600×600 dpi printing, if the system is configured for four scattered fluid-ejection mechanisms and each mechanism fires 512 drops and are spaced 0.25 inches apart and the fluid-ejection mechanism itself is 0.5 inches the print zone is calculated as:

Width: 4×512=2048 pixels

Length: (4×0.5)fluid-ejection mechanisms+(3×0.25) spaces=2.75 inches×600 dpi=1650 pixels. Therefore, the print image's width is exactly 2048 pixels.

If the configuration is inconsistent with the print image and the system 150 is unable to modify the print image to achieve consistency, then the system 150 communicates this inconsistency condition to the operator 170 via the UI device 160.

If the print image 190 is consistent with the system configuration 185, then the printer 100 commences printing the incoming print job at 534. Next, at 536, the process proceeds to the next print job.

If the print image 190 is inconsistent with the system configuration 185, but it's deviation is sufficiently minor, then print image 190 may be modified in accordance with the current system configuration 185 to achieve consistency. This may be done by adjusting the image size either by clipping or adding zeros to match the system configuration. However, this adjustment is available only within a defined threshold of deviation. Next, the printer 100 commences printing the incoming print job at 534. Then, at 536, the process proceeds to the next print job.

If the print image 190 is inconsistent (e.g., not fully aligned) with the system configuration 185, the operator 170 is notified, at 538, of this. This notification communicates this inconsistency condition to the operator 170 via the UI device 160. The notification includes information on how to re-adjust the system configuration to achieve consistency. In other words, it provides information on which fluid-ejection mechanisms need to be replaced with socket sealers. In a sense, the process returns from block 540 back to block 510, but the operator is now more informed. The printing stops at 540.

In general, the configuration 185 takes the precedence over the print image 190; therefore, the system typically fixes the print image not the configuration. Errors or inconsistencies within the configuration may be detected and reported to the operator.

The above has been described in the context of a human operator manually performing the fluid-ejection mechanism removal, fluid-ejection mechanism storage, and insertion of the smart socket sealers. The human does these things in response to the contamination management system 150 monitoring, analysis, and instructions.

Of course, those who are skilled in the art understand and appreciate that these human tasks may be automated using the appropriate mechanics. Such an automated system includes mechanics to remove designated unused fluid-ejection mechanisms, to move them to storage, and to retrieve socket sealers and inserted them.

Exemplary Printer Architecture

Figure 8:
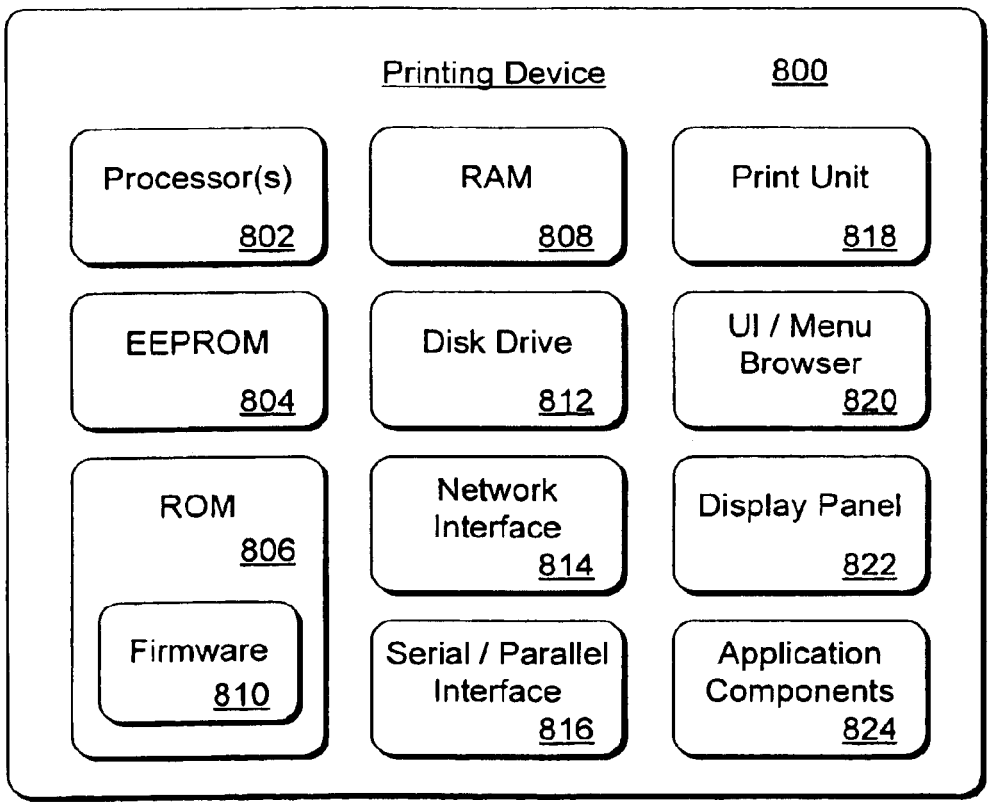
FIG. 8 is an example of a printing device capable of implementing (wholly or partially) an embodiment described herein.

FIG. 8 illustrates various components of an exemplary printing device 800 that can be utilized to implement the inventive techniques described herein. Printer 800 includes one or more processors 802, an electrically erasable programmable read-only memory (EEPROM) 804, ROM 806 (non-erasable), and a random access memory (RAM) 808. Although printer 800 is illustrated having an EEPROM 804 and ROM 806, a particular printer may only include one of the memory components. Additionally, although not shown, a system bus typically connects the various components within the printing device 800.

The printer 800 also has a firmware component 810 that is implemented as a permanent memory module stored on ROM 806. The firmware 810 is programmed and tested like software, and is distributed with the printer 800. The firmware 810 can be implemented to coordinate operations of the hardware within printer 800 and contains programming constructs used to perform such operations.

Processor(s) 802 process various instructions to control the operation of the printer 800 and to communicate with other electronic and computing devices. The memory components, EEPROM 804, ROM 806, and RAM 808, store various information and/or data such as configuration information, fonts, templates, data being printed, and menu structure information. Although not shown, a particular printer can also include a flash memory device in place of or in addition to EEPROM 804 and ROM 806.

Printer 800 also includes a disk drive 812, a network interface 814, and a serial/parallel interface 816. Disk drive 812 provides additional storage for data being printed or other information maintained by the printer 800. Although printer 800 is illustrated having both RAM 808 and a disk drive 812, a particular printer may include either RAM 808 or disk drive 812, depending on the storage needs of the printer. For example, an inexpensive printer may include a small amount of RAM 808 and no disk drive 812, thereby reducing the manufacturing cost of the printer.

Network interface 814 provides a connection between printer 800 and a data communication network. The network interface 814 allows devices coupled to a common data communication network to send print jobs, menu data, and other information to printer 800 via the network. Similarly, serial/parallel interface 816 provides a data communication path directly between printer 800 and another electronic or computing device. Although printer 800 is illustrated having a network interface 814 and serial/parallel interface 816, a particular printer may only include one interface component.

Printer 800 also includes a print unit 818 that includes mechanisms arranged to selectively apply ink (e.g., liquid ink, toner, etc.) to a print media such as paper, plastic, fabric, and the like in accordance with print data corresponding to a print job. For example, print unit 818 can include a conventional laser printing mechanism that selectively causes toner to be applied to an intermediate surface of a drum or belt. The intermediate surface can then be brought within close proximity of a print media in a manner that causes the toner to be transferred to the print media in a controlled fashion. The toner on the print media can then be more permanently fixed to the print media, for example, by selectively applying thermal energy to the toner.

Print unit 818 can also be configured to support duplex printing, for example, by selectively flipping or turning the print media as required to print on both sides. Those skilled in the art will recognize that there are many different types of print units available, and that for the purposes of the present invention, print unit 818 can include any of these different types.

Printer 800 also includes a user interface and menu browser 820, and a display panel 822. The user interface and menu browser 820 allows a user of the printer 800 to navigate the printer's menu structure. User interface 820 can be indicators or a series of buttons, switches, or other selectable controls that are manipulated by a user of the printer. Display panel 822 is a graphical display that provides information regarding the status of the printer 800 and the current options available to a user through the menu structure.

Printer 800 can, and typically does include application components 824 that provide a runtime environment in which software applications or applets can run or execute. One exemplary runtime environment is a Java Virtual Machine (JVM). Those skilled in the art will recognize that there are many different types of runtime environments available. A runtime environment facilitates the extensibility of printer 800 by allowing various interfaces to be defined that, in turn, allow the application components 824 to interact with the printer.

Exemplary Computer Architecture

Figure 9:
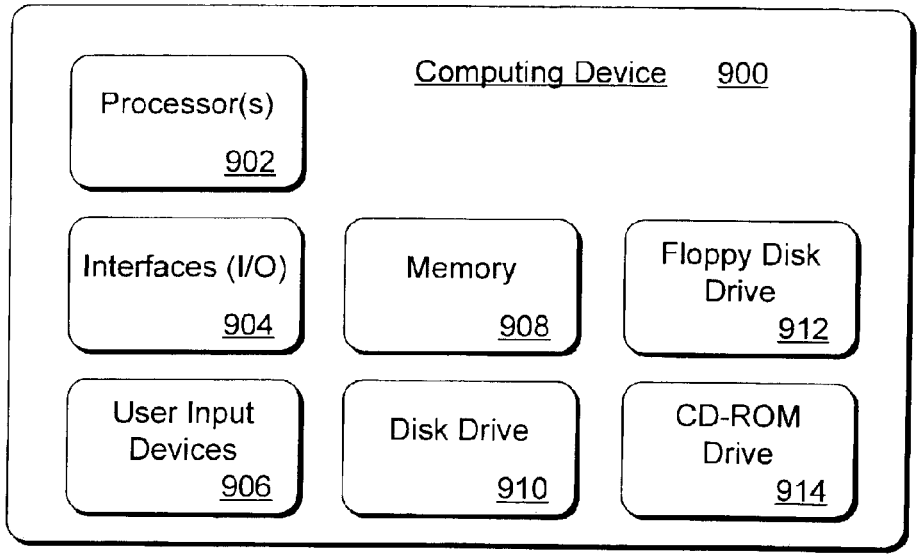
FIG. 9 is an example of a computing device capable of implementing (wholly or partially) an embodiment described herein.

FIG. 9 illustrates various components of an exemplary computing device 900 that can be utilized to implement the inventive techniques described herein. Computer 900 includes one or more processors 902, interfaces 904 for inputting and outputting data, and user input devices 906. Processor(s) 902 process various instructions to control the operation of computer 900, while interfaces 904 provide a mechanism for computer 900 to communicate with other electronic and computing devices. User input devices 906 include a keyboard, mouse, pointing device, or other mechanisms for interacting with, and inputting information to computer 900.

Computer 900 also includes a memory 908 (such as ROM and/or RAM), a disk drive 910, a floppy disk drive 912, and a CD-ROM drive 914. Memory 908, disk drive 910, floppy disk drive 912, and CD-ROM drive 914 provide data storage mechanisms for computer 900. Although not shown, a system bus typically connects the various components within the computing device 900.

What is claimed is:

1. A method for reducing contamination of fluid-ejection mechanisms and associated sockets, the method comprising:

analyzing a print job to identify a fluid-ejection mechanism that is unnecessary for printing the print job;

receiving communication from a socket sealer disposed in a socket vacated by the identified unnecessary fluid-ejection mechanism;

indicating whether the socket vacated by the unnecessary fluid-ejection mechanism is sealed, based upon the communication from the socket sealer.

2. A method as recited in claim 1 further comprising printing the print job only after the indicating indicates that the socket vacated by the unnecessary fluid-ejection mechanism is sealed.

3. A method as recited in claim 1 further comprising removing the identified unnecessary fluid-ejection mechanism from the socket.

4. A method as recited in claim 1 further comprising:

removing the identified unnecessary fluid-ejection mechanism from the sockets; and storing the identified unnecessary fluid-ejection mechanism in a fluid-ejection mechanism-servicing storage unit.

5. A method as recited in claim 1 further comprising storing the identified unnecessary fluid-ejection mechanism in a fluid-ejection mechanism-servicing storage unit.

6. A method as recited in claim 1 further comprising providing a user interface for reporting results of the analyzing and results of the indicating.

7. A method as recited in claim 1 further comprising replacing the identified unnecessary fluid-ejection mechanism with the socket sealer in the socket.

8. A computer-readable medium having computer-executable instructions that, when executed by a computer, performs a method for reducing contamination of fluid-ejection mechanisms and associated sockets, the method comprising:

analyzing a print job to identify a fluid-ejection mechanism that is unnecessary for printing the print job;

receiving communication from a socket sealer disposed in a socket vacated by the identified unnecessary fluid-ejection mechanism;

indicating whether the socket vacated by the unnecessary fluid-ejection mechanism is sealed, based upon the communication from the socket sealer.

9. A medium as recited in claim 8, wherein the method further comprises providing a user interface for reporting results of the analyzing and results of the indicating.

10. A contamination management system for reducing contamination of fluid-ejection mechanisms and associated sockets, the system comprising:

an analyzer configured to analyze a print job to identify a fluid-ejection mechanism that is unnecessary for printing the print job;

a monitor configured to monitor communication from a socket sealer in a socket vacated by the identified unnecessary fluid-ejection mechanisms;

a user interface configured to report the results of the analyzer and indicate whether the socket vacated by the identified unnecessary fluid-ejection mechanisms is sealed based upon communication from a socket sealer in a socket vacated by the identified unnecessary fluid-ejection mechanisms.

11. A system as recited in claim 10 further comprising a storage unit configured to store fluid-ejection mechanisms in a climate-controlled environment and to service fluid-ejection mechanisms stored therein.

12. A system as recited in claim 10, wherein the socket sealer has a non-volatile memory.

13. A system as recited in claim 10, wherein the socket sealer and the socket are configured to form a seal to prevent entry of contaminates into the socket.

14. A system as recited in claim 10, wherein the fluid-ejection mechanism is stationary during printing.

15. A system as recited in claim 10 further comprising a printer configured to print the print job only after the socket vacated by the unnecessary fluid-ejection mechanism is sealed.

16. A system as recited in claim 10, the fluid-ejection mechanism and associated socket configured so that the fluid-ejection mechanism is removable from the socket.

17. A method for reducing contamination of fluid-ejection mechanisms and associated sockets, the method comprising:

analyzing a print job to identify a fluid-ejection mechanism that is unnecessary for printing the print job;

replacing the identified unnecessary fluid-ejection mechanism in the socket with a socket sealer;

receiving communication from the socket sealer disposed in the socket vacated by the identified unnecessary fluid-ejection mechanism;

indicating whether the socket vacated by the unnecessary fluid-ejection mechanism is sealed, based upon the communication from the socket sealer;

providing a user interface for reporting results of the analyzing and results of the indicating;

printing the print job only after the indicating indicates that the socket vacated by the unnecessary fluid-ejection mechanism is sealed.

18. A method as recited in claim 17 further comprising storing the identified unnecessary fluid-ejection mechanism in a fluid-ejection mechanism-servicing storage unit.

19. A method for reducing contamination of fluid-ejection mechanisms and associated sockets, the method comprising:

analyzing a print job to identify an unnecessary fluid-ejection mechanism;

removing the identified fluid-ejection mechanism from a printer;

printing the print job with the identified fluid-ejection mechanism removed from the printer.

* * * * *